US011849909B2

(12) United States Patent
Zuo et al.

(10) Patent No.: US 11,849,909 B2
(45) Date of Patent: Dec. 26, 2023

(54) AUTOMATIC CLEANING APPARATUS

(71) Applicants: Beijing Shunzao Technology Co., Ltd., Beijing (CN); BEIJING XIAOMI MOBILE SOFTWARE CO., LTD., Beijing (CN)

(72) Inventors: Yongcheng Zuo, Beijing (CN); Cheng Tang, Beijing (CN); Fei Duan, Beijing (CN); Liang Zhong, Beijing (CN); Shan Gao, Beijing (CN); Tiantian Zhang, Beijing (CN)

(73) Assignees: BEIJING SHUNZAO TECHNOLOGY CO., LTD., Beijing (CN); BEIJING XIAOMI MOBILE SOFTWARE CO., LTD., Beijing (CN)

( * ) Notice: Subject to any disclaimer, the term of this patent is extended or adjusted under 35 U.S.C. 154(b) by 64 days.

(21) Appl. No.: 17/681,118

(22) Filed: Feb. 25, 2022

(65) Prior Publication Data

US 2023/0010167 A1 Jan. 12, 2023

(30) Foreign Application Priority Data

Jul. 7, 2021 (CN) ..... 202110767653.2

(51) Int. Cl.
*A47L 9/28* (2006.01)
*A47L 11/40* (2006.01)

(52) U.S. Cl.
CPC ..... *A47L 9/2836* (2013.01); *A47L 11/4011* (2013.01); *A47L 2201/04* (2013.01)

(58) Field of Classification Search
CPC ..... G05D 1/0227; G05D 2201/0215; B60L 3/0007; A47L 9/2836; A47L 11/4011; A47L 11/4061; A47L 2201/04
(Continued)

(56) References Cited

U.S. PATENT DOCUMENTS 10,646,089 B2 * 5/2020 Teng ..... A47L 11/4061

FOREIGN PATENT DOCUMENTS

CN 202776178 U * 3/2013
CN 207960251 U * 10/2018
(Continued)

OTHER PUBLICATIONS

Chinese Patent Application No. 202110767653.2 Office Action dated Mar. 2, 2022, 5 pages.
(Continued)

*Primary Examiner* — Brian D Keller
*Assistant Examiner* — Tim Brady
(74) *Attorney, Agent, or Firm* — COZEN O'CONNOR

(57) ABSTRACT

An automatic cleaning apparatus includes: a chassis; a front housing arranged at a front end of the chassis; and a sensing device capable sensing movement of the front housing and sending a signal to a control mainboard of the automatic cleaning apparatus when the front housing touches an obstacle and moves relative to the chassis. The sensing device includes a dust blocking member and a rocker arm that triggers the sensing device to send the signal. The rocker arm has a first end rotatably arranged inside the sensing device, and a second end passing through the dust blocking member and extending out of the sensing device. A front housing reset device is arranged on the chassis and capable of biasing the front housing toward an initial position of the front housing.

18 Claims, 3 Drawing Sheets

(58) Field of Classification Search
USPC ..... 15/319
See application file for complete search history.

(56) References Cited

FOREIGN PATENT DOCUMENTS

| | | | | |
|---|---|---|---|---|
| CN | 109008829 | A | | 12/2018 |
| CN | 111166235 | A | | 5/2020 |
| CN | 111973061 | A | | 11/2020 |
| CN | 112596524 | A | * | 4/2021 |
| CN | 213934632 | U | * | 8/2021 |

OTHER PUBLICATIONS

Chinese Patent Application No. 202110767653.2 English translation of Office Action dated Mar. 2, 2022, 6 pages.

* cited by examiner

AUTOMATIC CLEANING APPARATUS

CROSS-REFERENCE TO RELATED APPLICATIONS

The present disclosure claims benefit of and priority to Chinese Patent Application Serial No. 202110767653.2, filed on Jul. 7, 2021, the entire contents of which are incorporated herein by reference.

FIELD

The present disclosure relates to the field of cleaning apparatus and, more particularly, to an automatic cleaning apparatus.

BACKGROUND

An automatic cleaning apparatus cleans specific areas such as houses and offices by vacuuming dust or foreign objects as it moves. The automatic cleaning apparatus travels around an area to be cleaned so that the floor can be cleaned without user involvement.

SUMMARY

Embodiments of the present disclosure provide an automatic cleaning apparatus, including a chassis; a front housing arranged at a front end of the chassis; and a sensing device. The sensing device can sense movement of the front housing and send a signal to a control mainboard of the automatic cleaning apparatus when the front housing touches an obstacle and moves relative to the chassis. The sensing device includes a dust blocking member and a rocker arm. The rocker arm triggers the sensing device to send the signal; a first end of the rocker arm is rotatably arranged inside the sensing device, and a second end of the rocker arm passes through the dust blocking member and extends out of the sensing device. A front housing reset device is arranged on the chassis and capable of biasing the front housing toward an initial position of the front housing.

DETAILED DESCRIPTION OF EMBODIMENTS

For a better understanding of the foregoing technical solutions, some embodiments of the present disclosure will be described in detail below with reference to the accompanying drawings. Although some embodiments of the present disclosure are shown in the accompanying drawings, it is to be understood that the present disclosure can be implemented in various forms and should not be limited by the embodiments set forth herein. Rather, these embodiments are provided to allow for a clearer and more thorough understanding of the present disclosure and fully convey the scope of the present disclosure to those skilled in the art.

The automatic cleaning apparatus usually includes a vacuum cleaner unit for vacuuming dust or foreign objects, a moving unit for moving left and right motors of the automatic cleaning apparatus, a detection sensor for detecting various obstacles in the area to be cleaned, and a controller for performing the operation. The moving unit and the detection sensor are controlled to perform a cleaning process.

The automatic cleaning apparatus may inevitably collide with furniture or walls when cleaning the ground. In order to prevent the automatic cleaning apparatus from being broken, an anti-collision bumper is mounted at a front end of the moving unit, and the use of the high-strength anti-collision bumper protects the automatic cleaning apparatus from being broken. A sensing device is arranged between the anti-collision bumper and internal components of a chassis, part of the impact drives the sensing device to move, and a control mainboard drives the automatic cleaning apparatus to move in a direction away from obstacles after receiving a working state of the sensing device, which can ensure normal operation of the automatic cleaning apparatus.

However, dust may easily enter a main body of the sensing device during use due to the design of a rocker arm in the sensing device, and accumulate inside the sensing device, reducing the reliability of the sensing device; moreover, the rocker arm in the sensing device is not easy to reset after being impacted.

Figure 1:
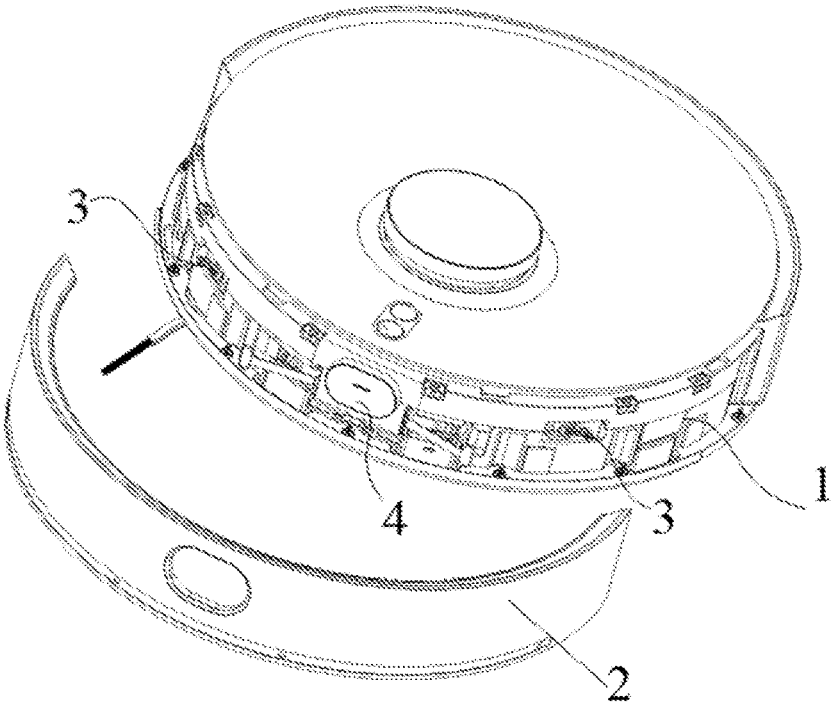
FIG. 1 is a schematic view of an automatic cleaning apparatus according to an embodiment of the present disclosure.
Figure 2:
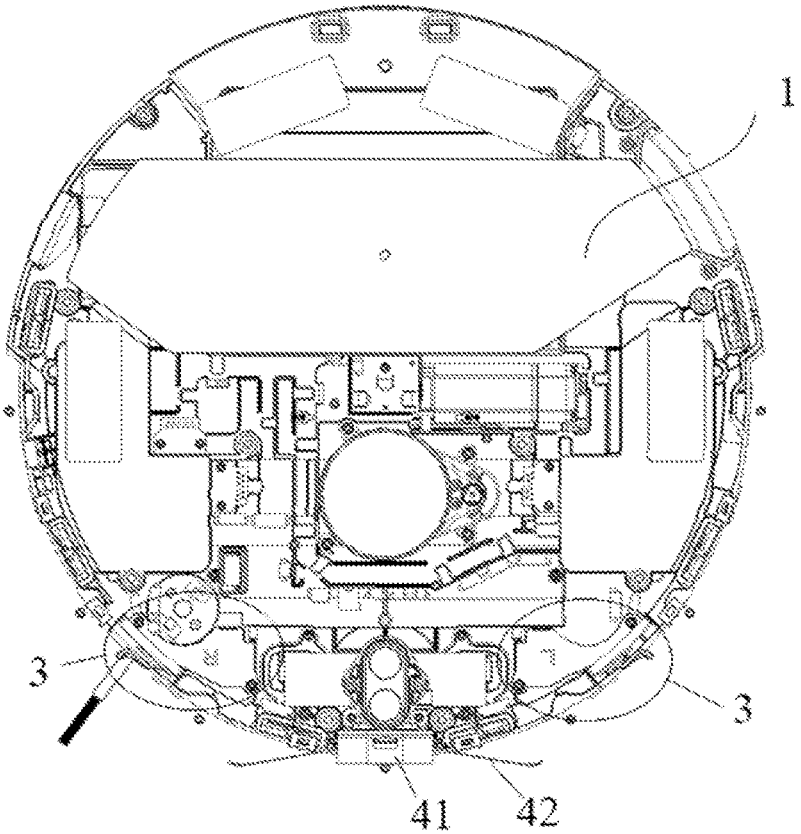
FIG. 2 is a schematic view of a chassis in FIG. 1 according to an embodiment of the present disclosure.

As shown in FIG. 1, embodiments of the present disclosure provides an automatic cleaning apparatus, including a front housing 2, a chassis 1, a sensing device 3 and a front housing reset device 4. The front housing reset device 4 is arranged on the chassis and can bias the front housing toward an initial position of the front housing. As illustrated in FIG. 2, the front housing reset device 4 is arranged in the middle of a front end of the chassis 1 and absorbs a large impact generated when the front housing 2 collides with an obstacle. The front housing 2 is arranged at the front end of the chassis 1. When the front housing touches the obstacle and moves relative to the chassis 1, that is, when the front housing 2 touches the sensing device 3 and is deformed, the sensing device 3 can sense the movement of the front housing 2 and send a signal to a control mainboard of the automatic cleaning apparatus, so that the control mainboard controls the automatic cleaning apparatus to move in direction away from the obstacle.

As shown in FIG. 2, the front housing reset device 4 includes a fixed seat 41 and two elastic members 42. The fixed seat 41 is fixed inside the chassis 1 by bolts. A first end of each elastic member 42 is snapped onto the fixed seat 41, and a second end of the elastic member 42 abuts against an inner side of the front housing 2. When the front housing 2 collides with the obstacle, the impact on the chassis 1 is passed on to the second end of the elastic member 42, which is in contact with the front housing 2, and the elastic member 42 is bent under pressure towards a side away from the front housing 2. The elastic potential energy of the elastic member 42 can cushion the impact, and an elastic force of the elastic member 42 itself makes the front housing 2 reset to the initial position after the collision force disappears.

Figure 3:
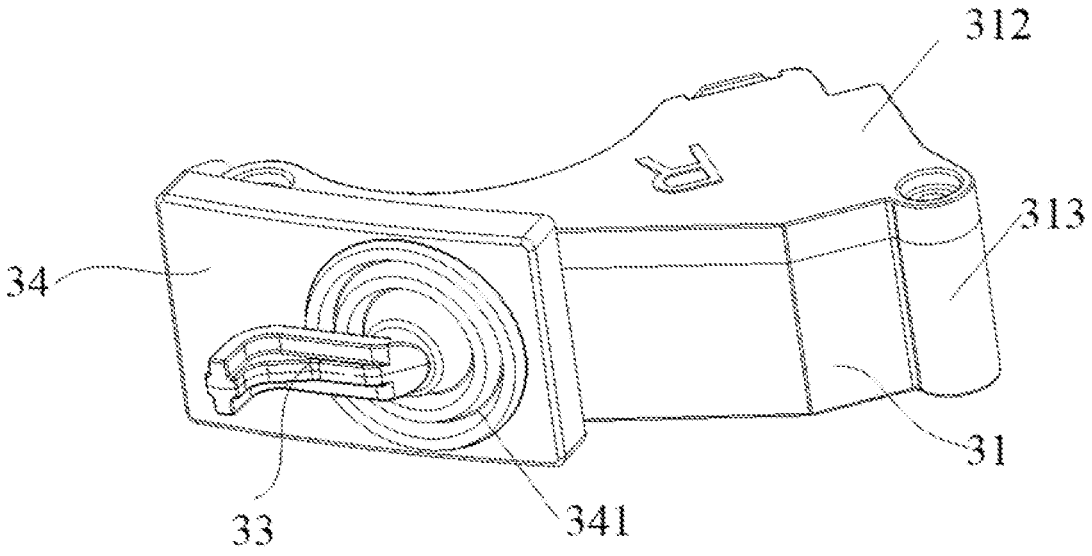
FIG. 3 is an enlarged view of a sensing device in FIG. 2 according to an embodiment of the present disclosure.
Figure 4:
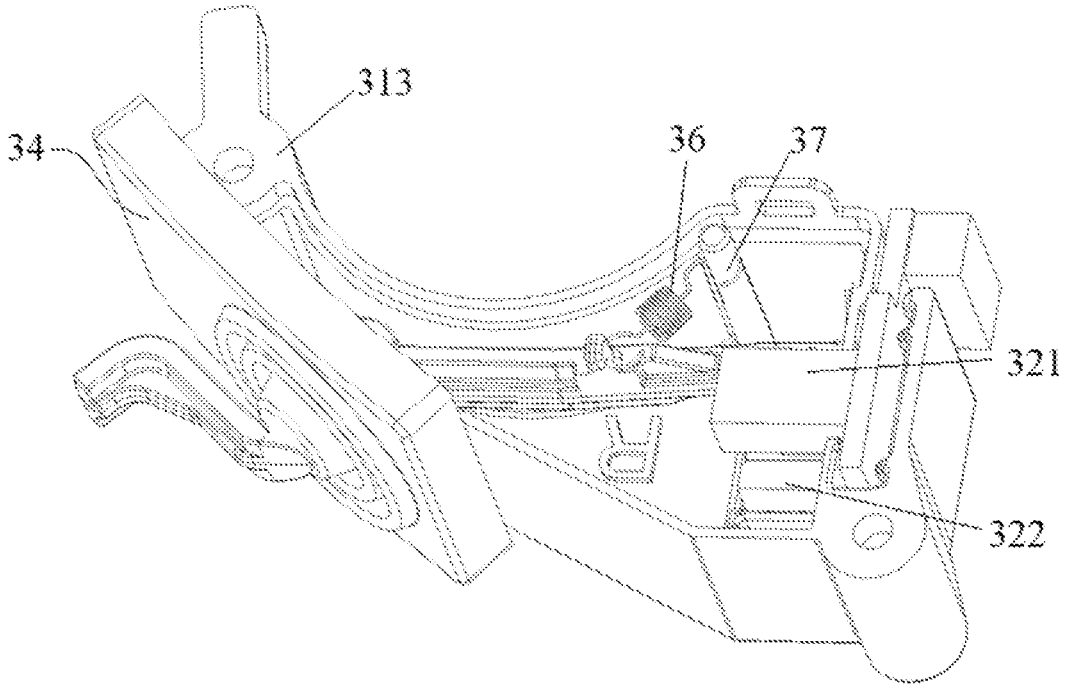
FIG. 4 is a schematic view of the sensing device of FIG. 3 with a top cover removed according to an embodiment of the present disclosure.

As shown in FIG. 3, the sensing device 3 includes a dust blocking member 34 and a rocker arm 33 that triggers the sensing device 3 to send the signal. A first end of the rocker arm 33 is rotatably arranged inside the sensing device 3, and a second end of the rocker arm 33 passes through the dust blocking member 34 and extends out of the sensing device 3. Certainly, as shown in FIG. 4, the sensing device 3 also includes a casing 31 and a sensor 32, and it should be noted that the sensor 32 is an obstacle sensor. The casing 31 is arranged inside the chassis 1, and the casing 31 is detachably coupled to the chassis 1, which facilitates the disassembly and assembly of the sensing device 3. The sensor 32 is arranged inside the casing 31, and the sensor 32 is used for communication with the control mainboard. During practical applications, the first end of the rocker arm 33 away from the front housing 2 is used to connect or disconnect the sensor 32, and the second end of the rocker arm 33 close to the front housing 2 passes through an output opening 311 of the casing 31 and abuts against the inner side of the front housing 2. The dust blocking member 34 covers the output opening 311 of the casing 31.

For the automatic cleaning apparatus provided by the embodiments of the present disclosure, since the dust blocking member 34 is arranged in the sensing device 3, and the rocker arm 33 passes through the dust blocking member 34 and extends out of the sensing device 3, the sealing performance of the dust blocking member 34 is good, and dust can be blocked from entering the sensing device 3 and affecting the sensitivity of the sensor 32 when the automatic cleaning apparatus is vacuuming dust, which improves the operational reliability of the automatic cleaning apparatus.

Specifically, as shown in FIG. 4, the sensor 32 includes a transmitting end 321 and a receiving end 322. When the front housing 2 is not collided by external force, an initial position of a tail end of the rocker arm 33 is located between the transmitting end 321 and the receiving end 322, so that sensor 32 is in a disconnected state and will not send any signal to the control mainboard, i.e., the automatic cleaning apparatus will not move in a reverse direction. When the front housing 2 is collided by external force, the front housing 2 comes into contact with the rocker arm 33, and the rocker arm 33 is rotated, i.e., the tail end of the rocker arm 33 leaves from between the transmitting end 321 and the receiving end 322, so that the sensor 32 is in a connected state and sends a signal to the control mainboard, i.e., the automatic cleaning apparatus moves in the reverse direction.

As shown in FIG. 3, the dust blocking member 34 also includes an elastic part 341. The elastic part 341 is coupled to the rocker arm 33 and can bias the rocker arm 33 toward an initial position of the rocker arm 33. Since the elastic part 341 is arranged on the dust blocking member 34, the elastic part 341 is coupled to the rocker arm 33, which facilitates the reset of the rocker arm 33 by pulling back the rocker arm 33 after the front housing 2 is collided by the external force.

Figure 6:
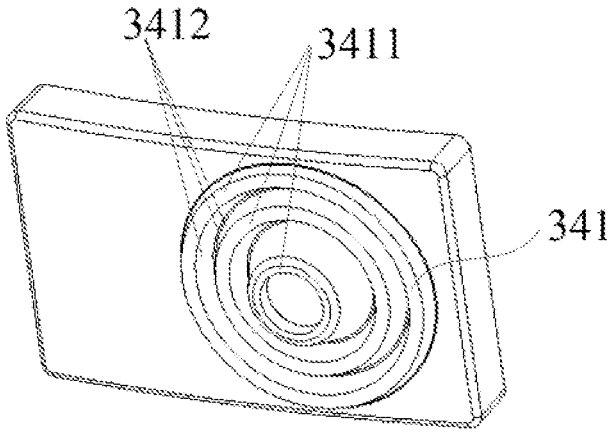
FIG. 6 is a schematic view of a dust blocking member in FIG. 3 according to an embodiment of the present disclosure.

As shown in FIG. 6, the elastic part 341 includes a plurality of elastic rings 3411 with gradually increasing diameters, and the plurality of elastic rings 3411 are sequentially fitted over one another along a radial direction of the elastic rings 3411. Along the radial direction of the elastic rings 3411, there is a gap between adjacent elastic rings 3411, and the adjacent elastic rings are coupled by an elastically stretchable portion 3412. The gap between adjacent elastic rings 3411 may reserve space for relative movement of adjacent elastic rings 3411, and adjacent elastic rings 3411 may move or twist relative to each other along the radial direction or an axial direction of the elastic rings 3411, to prevent the elastic part 341 from affecting normal rocking of the rocker arm 33 and ensure the sensitivity of the sensing device 3.

The plurality of elastic rings 3411 and the elastically stretchable portions 3412 are an integrally-formed pleated structure. An outermost elastic ring 3411 is coupled to the dust blocking member 34 by the elastically stretchable portion 3412, and an inner wall of an innermost elastic ring 3411 is sealingly coupled to an outer side of the rocker arm 33. During practical applications, the sealing connection may be an interference fit, bonding connection, or snap connection between the inner wall of the innermost elastic ring 3411 and the outer side of the rocker arm 33. When the front housing 2 is collided by external force, the rocker arm 33 comes into contact with the front housing 2 and is deflected under force. When the force acting on the rocker arm 33 is less than an elastic restoring force of the elastic part 341, the rocker arm 33 can be pulled back by the elastic part 341, which facilitates the reset of the rocker arm 33.

In this embodiment, the elastic part 341 adopts a plastic material, but certainly other elastic materials can be used. Along the axial direction of the elastic rings 3411, the elastic rings 3411 are flush with each other to reduce the space required for the arrangement of the elastic part 341.

Figure 5:
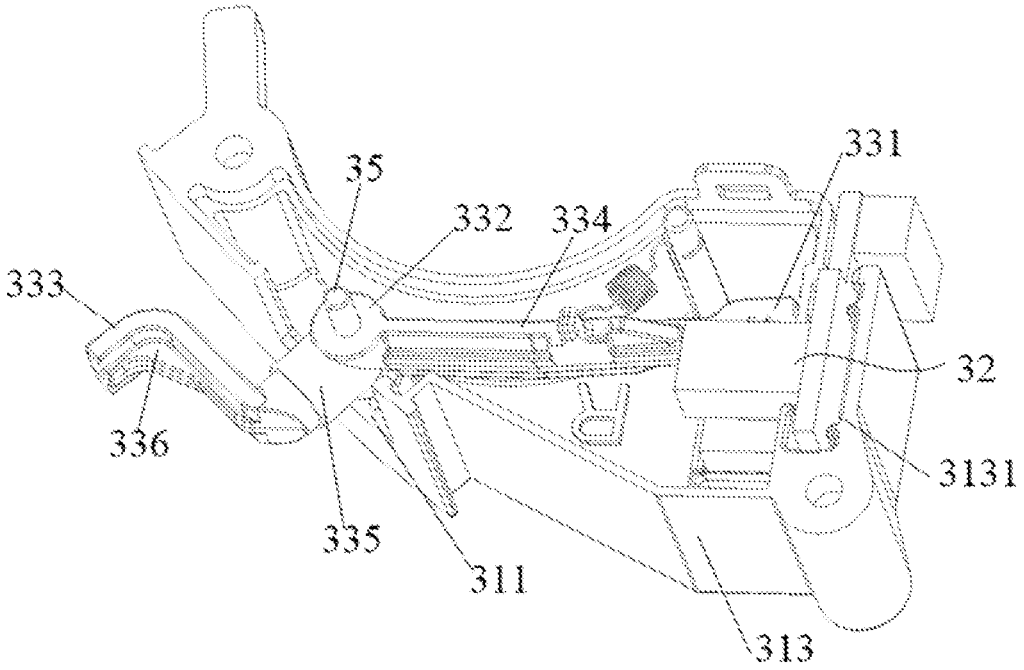
FIG. 5 is a schematic view of the sensing device of FIG. 3 with a top cover and a dust blocking member removed according to an embodiment of the present disclosure.

As shown in FIG. 5, the rocker arm 33 includes a shielding part 331, a rotating part 332 and a bowed part 333. The shielding part 331 is coupled to the rotating part 332 by a first connecting part 334, and the bowed part 333 is coupled to the rotating part 332 by a second connecting part 335. The second connecting part 335 is a connecting shaft that can increase a stress surface to prevent breakage, and the connecting shaft is fitted in a through hole of the innermost elastic ring 3411 of the dust blocking member 34. The shielding part 331 is movable between the transmitting end 321 and the receiving end 322 of the sensor 32. The rotating part 332 is fitted over a support post 35 inside the casing 31, and the rotating part 332 can rotate around the support post 35 to drive the bowed part 333 and the shielding part 331, both of which are coupled to the rotating part 332, to rotate synchronously. During practical applications, the bowed part 333 abuts against the inner side of the front housing 2, and when the front housing 2 of the automatic cleaning apparatus comes into contact with an obstacle, the bowed part 333 of the rocker arm 33 is subjected to external force to make the rotating part 332 rotate around the support post 35 and thus bring the shielding part 331 into rotation, and the shielding part 331 leaves from between the transmitting end 321 and the receiving end 322, so that the sensor 32 turns into the connected state.

A transverse section of the bowed part 333 is L-shaped. In order to allow the bowed part 333 to contact force transmission in all directions, a longitudinal section of the bowed part 333 at an end abutting against the front housing 2 is cross-shaped. In order to enhance the strength of the L-shaped bowed part 333, a reinforcement rib 336 is arranged at a bend of the bowed part 333, and an inclined surface is designed at a junction between the bowed part 333 and the second connecting part 335 to save internal space.

During practical applications, in order to prevent the elastic part 341 from interfering with the normal movement of the rocker arm 33 and affecting the sensitivity of the rocker arm 33, the elastic force of the elastic part 341 is usually small. The sensing device 3 also includes a reset member 36 and a positioning post 37; the reset member 36 is a spring, and pull hooks are arranged on both sides of the spring; the positioning post 37 is arranged in the casing 31 and located on one side of the sensor 32; and the pull hook at a first end of the spring is coupled to the positioning post 37 and the pull hook at a second end of the spring is coupled to a pull hook on the first connecting part 334 of the rocker arm 33. The dual function of the reset member 36 and the elastic part 341 on the dust blocking member 34 is to facilitate the reset of the bowed part 333 of the rocker arm 33. The reset member 36 and the positioning post 37 are easy to install and remove.

As shown in FIG. 3, the casing 31 includes a top cover 312 and a lower sub-casing 313, the lower sub-casing 313 is open at a top end thereof, and the top cover 312 is snap-fitted to the top end of the lower sub-casing 313. The casing 31 has a mounting hole for easy installation and removal of the casing 31.

A sensor holding groove 3131 is arranged in the lower sub-casing 313, and one end of the sensor 32 is detachably coupled in the sensor holding groove 3131 to facilitate the installation and removal of the transmitting end 321 and the receiving end 322 of the sensor 32.

During practical applications, the automatic cleaning apparatus includes a main body structure, a cleaning system, a sensing system, a control system, a drive system, an energy system, and a human-computer interaction system. The major parts of the automatic cleaning apparatus will be described in detail below.

The main body structure includes a frame, a front part, a rear part, and the chassis 1. The main body structure may have an approximately circular shape, i.e., the front part and the rear part are both round, or may have other shapes including but not limited to an approximately D-shaped form with a square front part and a round rear part.

The sensing system includes a position sensor located above the main body structure, a buffer located in the front part of the main body structure, an obstacle avoidance sensor, an infrared sensor, a magnetometer, an accelerometer, a gyroscope, an odometer, and other sensing devices. These sensing devices provide various position information and motion status information of the machine to the control system. In a preferred embodiment, the position sensor includes but is not limited to a laser emitter, a vision camera, a dynamic vision sensor, and a laser distance measuring device.

The cleaning system includes a dry cleaning part and a wet cleaning part. The wet cleaning part serves as a first cleaning part, which mainly functions to wipe a surface to be cleaned (e.g., the ground) with a cleaning cloth containing a cleaning solution. The dry cleaning part serves as a second cleaning part, which mainly functions to sweep away solid particulate contaminants from the surface to be cleaned by a structure such as a sweeping brush.

As the dry cleaning part, the main cleaning function is derived from the second cleaning part consisting of a roller brush, a dust box, a blower, an air outlet, and connections among the four. A main brush, which has a certain interference with the ground, sweeps up particles on the ground and rolls them up to a front side of a suction port between the main brush and the dust box, and the particles are then sucked into the dust box by a suction gas generated by the blower and passing through the dust box. The dust removal capacity of the automatic cleaning apparatus can be characterized by a DPU (dust pick up) efficiency, which is affected by the structure and material of the main brush, by the utilization rate of wind power in an air duct formed by the suction port, the dust box, the blower, the air outlet, and the connections among the four, and by the type and power of the blower. The dry cleaning system may also include an edge brush having a rotating shaft at an angle with respect to the ground, to move debris into a sweeping area of the main brush of the second cleaning part.

As the wet cleaning part, the first cleaning part mainly includes a liquid container and a cleaning cloth. The liquid container serves as a base for carrying other members of the first cleaning part. The cleaning cloth is detachably arranged on the liquid container. The liquid in the liquid container flows to the cleaning cloth, and the cleaning cloth wipes the ground that has been cleaned by the roller brush.

The drive system is used to drive the main body structure and the components on it, realizing automatic walking and sweeping. The drive system includes a drive wheel module that can send a drive command and manipulate the automatic cleaning apparatus across the ground based on distance and angle information. The drive wheel module can control both left and right wheels simultaneously, and in some embodiments may include a left drive wheel module and a right drive wheel module for more precise control over the machine's movement. The left and right drive wheel modules are arranged oppositely and symmetrically along a transverse axis defined by the main body structure. In order to enable the automatic cleaning apparatus to move more stably on the ground or have stronger movement capability, the automatic cleaning apparatus may include one or more driven wheels, which include but are not limited to universal wheels.

The drive wheel module includes a travel wheel, a drive motor and a control circuit for controlling the drive motor. The drive wheel module can also be coupled to a drive current measurement circuit and an odometer. The drive wheel module may be detachably attached to the main body structure for easy disassembly and maintenance. The drive wheel may have a bias drop suspension system, and the bias drop suspension system is fastened in a removable manner, which is for example attached in a rotatable manner, to the main body structure and receives a spring bias that is biased downward and away from the main body structure. The spring bias allows the drive wheel to maintain contact with the ground and traction with a certain force, and a cleaning element of the automatic cleaning apparatus, such as the roller brush, also contacts the ground with a certain pressure.

The front part of the main body structure may carry a buffer, which detects one or more events in a travel path of the automatic cleaning apparatus through a series of triggering principles, such as the light fracture principle, when the drive wheel module propels the automatic cleaning apparatus on the ground during a cleaning process. The automatic cleaning apparatus may respond to the events detected by the buffer, such as obstacles and walls, by controlling the drive wheel module, and for example, the automatic cleaning apparatus may move away from the obstacles.

Generally, in a process of using the automatic cleaning apparatus, in order to prevent the automatic cleaning apparatus from entering a forbidden area in the house, e.g., an area where there are fragile objects, or an area where there is water on the ground, like a bathroom, the automatic cleaning apparatus further includes a forbidden area detector. The forbidden area detector includes a virtual wall sensor that may provide a virtual wall according to settings of a user to define the forbidden area and may control the drive wheel module to restrict the automatic cleaning apparatus from crossing a boundary of the forbidden area, i.e., the virtual wall, and entering the forbidden area when detecting the virtual wall.

In addition, in the process of using the automatic cleaning apparatus, in order to prevent the automatic cleaning apparatus from falling down from indoor stairs, higher steps and so on, the forbidden area detector also includes a cliff sensor that may provide a boundary according to settings of the user to define the forbidden area and may control the drive wheel module to restrict the automatic cleaning apparatus from crossing the boundary of the forbidden area and prevent the automatic cleaning apparatus from falling down from the steps, when detecting the boundary of the forbidden area.

The control system is arranged on a circuit main board within the main body structure and includes a computing processor (e.g., a central processing unit or an application processor) communicating with a non-transitory memory, such as a hard disk, a flash memory, and a random access memory. The application processor draws a real-time map of the environment where the automatic cleaning apparatus is located based on obstacle information fed back from the laser distance measuring device using a positioning algorithm. By combining distance information and speed information fed back by the buffer, the cliff sensor, the ultrasonic sensor, the infrared sensor, the laser sensor, the magnetometer, the accelerometer, the gyroscope, the odometer and other sensing devices, it is possible to determine a current working state of the automatic cleaning apparatus comprehensively (for example, the automatic cleaning apparatus is crossing a doorsill, traveling onto a carpet, located at the cliff, or gets stuck with its upper part or lower part, or the dust box is full or picked up etc.) and provide specific strategies for next action in different situations, making the automatic cleaning apparatus satisfy the user's requirements better and bringing about better user experience. Further, the control system can plan the most efficient and reasonable cleaning path and cleaning method based on the real-time map information drawn by SLAM, which greatly improves the cleaning efficiency of the automatic cleaning apparatus.

The energy system includes a rechargeable battery, such as a lithium battery and a polymer battery. The rechargeable battery can be coupled to a charging control circuit, a battery pack charging temperature detection circuit, and a battery under-voltage monitoring circuit. The charging control circuit, the battery pack charging temperature detection circuit, and the battery under-voltage monitoring circuit are coupled to a microcontroller control circuit. The main body is coupled to a charging pile through a charging electrode arranged on a side of or below the main body and get charged. If the exposed charging electrode is covered with dust, a plastic body around the electrode will melt and deform during charging due to a cumulative effect of electric charge, which may even lead to deformation of the electrode itself and makes it impossible to continue charging normally.

The automatic cleaning apparatus has a signal receiver at the front end to receive a signal from the charging pile. The signal is usually infrared, and in some more advanced technologies, the signal may be a graphic signal. Normally, when the automatic cleaning apparatus departs from the charging pile, the system remembers a location of the charging pile, so that when the automatic cleaning apparatus finishes cleaning, or when it is low on power, the automatic cleaning apparatus will control the drive wheel system to drive towards the location of the charging pile stored in the memory and get coupled to the pile and charged.

The human-machine interaction system includes buttons on the host panel, enabling the user to perform function selections, and may also include a display and/or an indicator and/or a speaker, which show the user a current state or selected function item of the machine, and may also include a mobile phone client program. For a cleaning apparatus with path navigation, it is possible to show the user a map of the environment where the apparatus is located, as well as a position of the apparatus, which provides the user with richer and more user-friendly function items.

In order to describe the behavior of the automatic cleaning apparatus more clearly, the following orientations are defined. The automatic cleaning apparatus can travel on the ground by various combinations of movements relative to the following three mutually perpendicular axes defined by the main body structure: a front-rear axis X, i.e., an axis along the front and rear parts of the main body structure; a transverse axis Y, i.e., an axis perpendicular to the axis X and at a same level as the axis X; and a central perpendicular axis Z, i.e., an axis perpendicular to a plane formed by the axis X and the axis Y. A forward driving direction along the front-rear axis X is labeled as "forward" and a backward driving direction along the front-rear axis X is labeled as "backward". The transverse axis Y is essentially an axis extending between right and left wheels of the automatic cleaning apparatus along an axis defined by a center point of the drive wheel module.

The automatic cleaning apparatus can pivot around the axis Y. When a forward portion of the automatic cleaning apparatus is tilted upward and a rearward portion is tilted downward, it is "tilted up". When the forward portion of the automatic cleaning apparatus is tilted downward and the rearward portion is tilted upward, it is "tilted down". In addition, the automatic cleaning apparatus can pivot around the axis Z. In a front-rear direction of the automatic cleaning apparatus, when the automatic cleaning apparatus is tilted to a right side of the axis X, it "turns right" and when tilted to a left side of the axis X, it "turns left".

The dust box is mounted in an accommodation cavity at the rear of the main body of the machine by a mechanical gripper. A snap retracts when the gripper is gripped, and the snap extends into and snaps into a groove in the accommodation cavity when the gripper is released.

In addition, terms such as "first" and "second" are used herein for purposes of description and are not intended to indicate or imply relative importance or the number of indicated technical features. Thus, the feature defined with "first" and "second" may include one or more this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also communicate with each other; may also be direct connections or indirect connections via intervening structures; may also be inner connection or mutual interaction of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "one embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. Moreover, different embodiments or examples as well as features in different embodiments or examples may be combined or integrated by those skilled in the art, on the premise of no conflict.

Although embodiments of the present disclosure have been shown and described, it would be appreciated that the above embodiments are exemplary and cannot be construed to limit the present disclosure, and changes, modifications, alternatives and variations can be made in the embodiments without departing from the scope of the present disclosure.

What is claimed is:

1. An automatic cleaning apparatus, comprising:

a chassis;

a front housing arranged at a front end of the chassis; and a sensing device that senses movement of the front housing and sends a signal to a control mainboard of the automatic cleaning apparatus when the front housing touches an obstacle and moves relative to the chassis, wherein:

the sensing device comprises a dust blocking member and a rocker arm, the rocker arm triggers the sensing device to send the signal;

a first end of the rocker arm is rotatably arranged inside the sensing device, and a second end of the rocker arm passes through the dust blocking member and extends out of the sensing device; and a front housing reset device is arranged on the chassis and capable of biasing the front housing toward an initial position of the front housing, wherein the dust blocking member further comprises an elastic part coupled to the rocker arm and capable of biasing the rocker arm toward an initial position of the rocker arm, the elastic part comprises a plurality of elastic rings with gradually increasing diameters, and the plurality of elastic rings are sequentially fitted over one another along a radial direction of the elastic rings; and the elastic rings are flush with each other along an axial direction of the elastic rings.

2. The automatic cleaning apparatus according to claim 1, wherein the elastic part is made of a plastic material.

3. The automatic cleaning apparatus according to claim 1, wherein the front housing reset device includes a fixed seat and two elastic members; the fixed seat is fixed inside the chassis by bolts; a first end of each elastic member is snapped onto the fixed seat, and a second end of the elastic member abuts against an inner side of the front housing.

4. The automatic cleaning apparatus according to claim 1, wherein:

along the radial direction of the elastic rings, there is a gap between adjacent elastic rings, and the adjacent elastic rings are coupled by an elastically stretchable portion;

an inner wall of an innermost elastic ring is sealingly coupled to an outer side of the rocker arm.

5. The automatic cleaning apparatus according to claim 4, wherein the plurality of elastic rings and the elastically stretchable portions are an integrally-formed pleated structure, and an outermost elastic ring is coupled to the dust blocking member by the elastically stretchable portion.

6. The automatic cleaning apparatus according to claim 4, wherein the inner wall of the innermost elastic ring and the outer side of the rocker arm are coupled by an interference fit.

7. The automatic cleaning apparatus according to claim 1, wherein:

the sensing device further comprises a casing arranged inside the chassis, and a sensor arranged inside the casing and communicating with the control mainboard;

the first end, away from the front housing, of the rocker arm connects or disconnects the sensor, and the second end, close to the front housing, of the rocker arm passes through the dust blocking member and abuts against an inner side of the front housing.

8. The automatic cleaning apparatus according to claim 7, wherein:

the casing is detachably coupled to the chassis;

the casing comprises a top cover and a lower sub-casing; and the lower sub-casing has an open top end, and the top cover is snap-fitted to the top end of the lower sub-casing.

9. The automatic cleaning apparatus according to claim 8, wherein a sensor holding groove is arranged in the lower sub-casing, and an end of the sensor is detachably coupled in the sensor holding groove.

10. The automatic cleaning apparatus according to claim 7, wherein:

the rocker arm comprises a shielding part, a rotating part and a bowed part;

the shielding part is coupled to the rotating part by a first connecting part, and the bowed part is coupled to the rotating part by a second connecting part;

the shielding part is movable in the sensor, the rotating part is fitted over a support post inside the casing, and the bowed part abuts against the inner side of the front housing;

a transverse section of the bowed part is L-shaped, and a longitudinal section of the bowed part at an end abutting against the front housing is cross-shaped.

11. The automatic cleaning apparatus according to claim 10, wherein a reinforcement rib is arranged at a bend of the bowed part.

12. The automatic cleaning apparatus according to claim 10, wherein:

the sensing device further comprises a reset member and a positioning post;

the positioning post is arranged in the casing; and a first end of the reset member is coupled to the positioning post and a second end of the reset member is coupled to the rocker arm.

13. The automatic cleaning apparatus according to claim 10, wherein an inclined surface is designed at a junction between the bowed part and the second connecting part.

14. The automatic cleaning apparatus according to claim 1, wherein:

the sensing device further comprises an obstacle sensor having a transmitting end and a receiving end; and the rocker arm is movable between a first position where the rocker arm is located between the transmitting end and the receiving end and the obstacle sensor is in a disconnected state and a second position where the rocker arm is rotated away from between the transmitting end and the receiving end and the obstacle sensor is in a connected state.

15. The automatic cleaning apparatus according to claim 14, wherein the dust blocking member further comprises an elastic part coupled to the rocker arm and capable of biasing the rocker arm toward the first position of the rocker arm.

16. The automatic cleaning apparatus according to claim 14, wherein the rocker arm comprises a shielding part, a rotating part and a bowed part; and the shielding part is coupled to the rotating part by a first connecting part, and the bowed part is coupled to the rotating part by a second connecting part.

17. The automatic cleaning apparatus according to claim 16, wherein the second connecting part is a connecting shaft.

18. The automatic cleaning apparatus according to claim 16, wherein the shielding part is movable between the transmitting end and the receiving end and is fitted over a support post inside the casing, and the rotating part is rotatable around the support post to drive the bowed part and the shielding part to rotate synchronously.

* * * * *